US011038281B2

(12) United States Patent
Franson et al.

(10) Patent No.: US 11,038,281 B2
(45) Date of Patent: Jun. 15, 2021

(54) LOW PROFILE ANTENNA APPARATUS

(71) Applicant: VIASAT, INC., Carlsbad, CA (US)

(72) Inventors: Steven J. Franson, Scottsdale, AZ (US); Douglas J. Mathews, Mesa, AZ (US)

(73) Assignee: VIASAT, INC., Carlsbad, CA (US)

( * ) Notice: Subject to any disclaimer, the term of this patent is extended or adjusted under 35 U.S.C. 154(b) by 4 days.

(21) Appl. No.: 16/460,641

(22) Filed: Jul. 2, 2019

(65) Prior Publication Data

US 2021/0005977 A1 Jan. 7, 2021

(51) Int. Cl.

| | |
|---|---|
| ***H01Q 21/22*** | (2006.01) |
| ***H01Q 1/38*** | (2006.01) |
| ***H01Q 1/02*** | (2006.01) |
| ***H01Q 21/00*** | (2006.01) |
| ***H01Q 1/48*** | (2006.01) |
| ***H01Q 3/38*** | (2006.01) |

(52) U.S. Cl.

CPC ..... *H01Q 21/0025* (2013.01); *H01Q 1/02* (2013.01); *H01Q 1/38* (2013.01); *H01Q 1/48* (2013.01); *H01Q 3/38* (2013.01); *H01Q 21/0087* (2013.01); *H01Q 21/22* (2013.01)

(58) Field of Classification Search

CPC ..... H01Q 21/0025; H01Q 21/0087; H01Q 21/22; H01Q 1/38; H01Q 1/48; H01Q 1/02; H01Q 3/38

USPC ..... 343/848

See application file for complete search history.

(56) References Cited

U.S. PATENT DOCUMENTS

| | | | | |
|---|---|---|---|---|
| 6,166,705 | A * | 12/2000 | Mast | H01Q 1/38 342/372 |
| 7,168,152 | B1 * | 1/2007 | Ehret | H01Q 13/0283 29/600 |
| 7,348,932 | B1 * | 3/2008 | Puzella | H01Q 21/0025 342/373 |
| 7,557,433 | B2 * | 7/2009 | McCain | H04B 1/1615 257/678 |
| 7,786,944 | B2 * | 8/2010 | Franson | H01Q 13/085 343/770 |
| 9,537,216 | B1 * | 1/2017 | Kontopidis | H01Q 3/26 |
| 2005/0035915 | A1 * | 2/2005 | Livingston | H01Q 1/422 343/754 |
| 2009/0044399 | A1 | 2/2009 | Quil et al. | |

(Continued)

FOREIGN PATENT DOCUMENTS

| | | |
|---|---|---|
| FR | 2773272 | 7/1999 |
| WO | 2017222471 | 12/2017 |

OTHER PUBLICATIONS

International Search Report dated Apr. 9, 2021 in corresponding PCT Application No. PCT/US2020/040197 (12 pages).

*Primary Examiner* — Hai V Tran

(74) *Attorney, Agent, or Firm* — F. Chau & Associates, LLC

(57) ABSTRACT

Disclosed is an antenna apparatus including a first subassembly having a plurality of antenna elements, and a second subassembly adhered to the first subassembly. The second subassembly may include a plurality of components of a beamforming network encapsulated within a molding material. One or more interconnect layers may be disposed on the molding material to electrically couple the plurality of components of the beamforming network to the plurality of antenna elements. Methods of fabricating the antenna apparatus are also disclosed.

26 Claims, 16 Drawing Sheets

(56) References Cited

U.S. PATENT DOCUMENTS

| | | | | |
|---|---|---|---|---|
| 2014/0320376 | A1* | 10/2014 | Ozdemir | H01Q 9/0442 343/876 |
| 2015/0084814 | A1* | 3/2015 | Rojanski | H01Q 1/42 342/368 |
| 2018/0205134 | A1 | 7/2018 | Khan et al. | |
| 2019/0013580 | A1* | 1/2019 | Vigano | H01Q 3/40 |
| 2019/0027804 | A1 | 1/2019 | Kim et al. | |

* cited by examiner

LOW PROFILE ANTENNA APPARATUS

TECHNICAL FIELD

This disclosure relates generally to antenna arrays.

DISCUSSION OF RELATED ART

Antenna arrays are currently deployed in a variety of applications at microwave and millimeter wave frequencies, such as in aircraft, satellites, vehicles, and base stations for general land-based communications. Such antenna arrays typically include microstrip radiating elements driven with phase shifting beamforming circuitry to generate a phased array for beam steering. In many cases it is desirable for an entire antenna system, including the antenna array and beamforming circuitry, to occupy minimal space with a low profile while still meeting requisite performance metrics.

SUMMARY

In an aspect of the presently disclosed technology, an antenna apparatus includes a first subassembly with a plurality of antenna elements, and a second subassembly adhered to the first subassembly. The second subassembly includes a plurality of components of a beamforming network encapsulated within a molding material, and one or more interconnect layers on the molding material. The one or more interconnect layers electrically couple the plurality of components of the beamforming network to the plurality of antenna elements.

The components may include integrated circuit (IC) chips with phase shifters dynamically controlled, such that the antenna apparatus is operational as a phased array.

In another aspect, a method of forming an antenna apparatus involves: forming a first subassembly comprising a plurality of antenna elements; and encapsulating a plurality of beamforming components of a beamforming network within a molding material to form an embedded component structure. One or more interconnect layers may then be formed on the embedded component structure, thereby forming a second subassembly. The first subassembly may then be adhered and electrically connected to the second subassembly so that the plurality of beamforming components are electrically coupled to the plurality of antenna elements.

BRIEF DESCRIPTION OF THE DRAWINGS

The above and other aspects and features of the disclosed technology will become more apparent from the following detailed description, taken in conjunction with the accompanying drawings in which like reference numerals indicate like elements or features, wherein.

DETAILED DESCRIPTION OF EMBODIMENTS

The following description, with reference to the accompanying drawings, is provided to assist in a comprehensive understanding of certain exemplary embodiments of the technology disclosed herein for illustrative purposes. The description includes various specific details to assist a person of ordinary skill the art with understanding the technology, but these details are to be regarded as merely illustrative. For the purposes of simplicity and clarity, descriptions of well-known functions and constructions may be omitted when their inclusion may obscure appreciation of the technology by a person of ordinary skill in the art.

Figure 1:
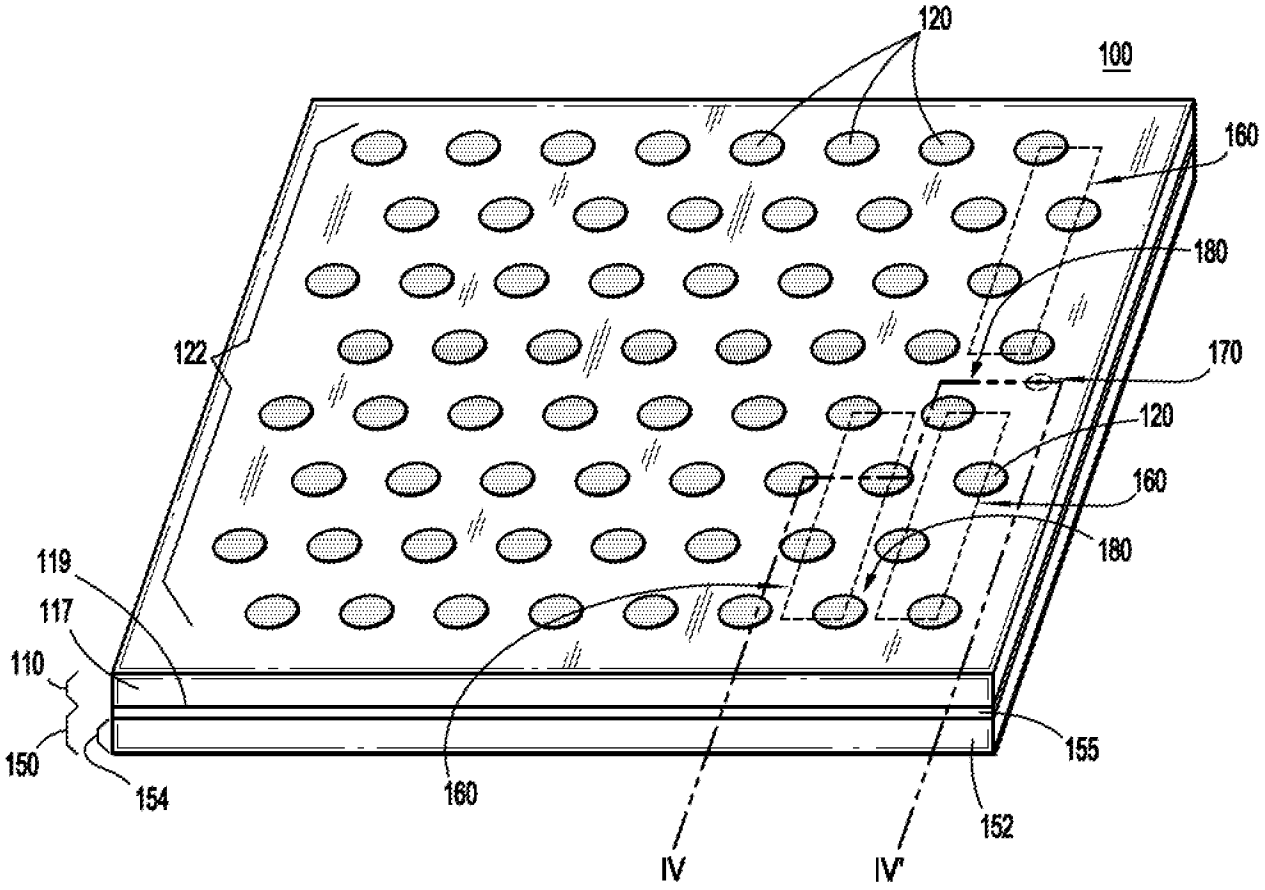
FIG. 1 is a perspective view of an example antenna apparatus according to an embodiment.

FIG. 1 is a perspective view of an example antenna apparatus, 100, according to an embodiment. Antenna apparatus 100 may include an antenna subassembly 110 adhered to an embedded component subassembly 150 to form a stacked structure with a low profile. Antenna subassembly 110 includes a plurality of antenna elements 120 spatially arranged across a top major surface of a substrate 117 to form an antenna array 122. The number of antenna elements 120, their type, sizes, shapes, inter-element spacing, and the manner in which they are driven may be varied by design to achieve targeted performance metrics. Examples of such performance metrics include beamwidth, pointing direction, polarization, sidelobes, power loss, beam shape, etc., over a requisite frequency band. In a typical case, antenna array 122 includes at least 16 antenna elements 120. Antenna elements 120 may be microstrip patch antenna elements as illustrated in FIG. 1, but other radiator types such as printed dipoles or slotted elements may be substituted. A ground plane 119 may be formed on a bottom major surface of substrate 117. Depending on the application, antenna elements 120 may be connected to beamforming components for transmitting and/or or receiving RF signals. The description hereafter will assume antenna apparatus 100 has concurrent transmit and receive capability, but other embodiments may be configured for just receive or transmit. In one example, antenna elements 120 are designed for operation over a millimeter (mm) wave frequency band, generally defined as a band within the 30 GHz to 300 GHz range. In other examples, antenna elements 120 are designed to operate below 30 GHz.

Figure 2A:
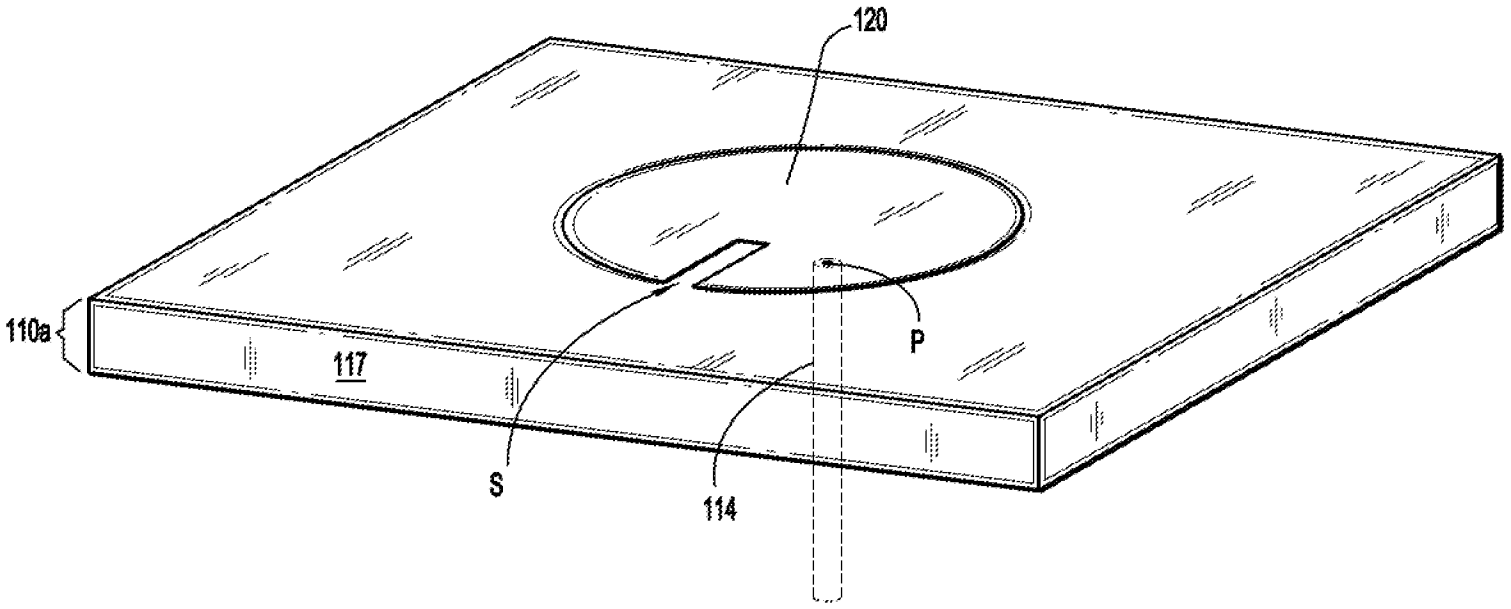
FIG. 2A is a perspective view of an example antenna element of the antenna apparatus.

Referring momentarily to FIG. 2A, one example of an antenna element 120 within antenna apparatus 100 is illustrated in a perspective view. (FIG. 2B, discussed later, shows antenna element 120 in a cross-sectional view.) Antenna element 120 may be printed on a top surface of substrate 117, or may be disposed within substrate 117 beneath the top surface. Ground plane 119, which may be metallization printed on a bottom surface of substrate 117, reflects signal energy to/from the antenna elements 120. Substrate 117 may be a low loss tangent material such as quartz or fused silica. This can be particularly beneficial in a high frequency operation for minimizing losses. Each antenna element 120 may be driven by a respective microstrip probe feed 114 extending vertically through substrate 117 and connected directly to a lower surface of the antenna element at a point p. Microstrip probe feed 114 may be formed as a through-substrate-via (TSV) (hereafter, "via") through substrate 117. Thus, a plurality of probe feeds 114 feeding a respective plurality of antenna elements 120 may be considered an array of vias extending through dielectric 117. The point p may be chosen at a location within the body of the antenna element 120 to achieve a desired polarization (e.g., circular when offset a certain distance from center). A slit 121 may be formed in the patch element for impedance matching. Note that in alternative designs, the probe feed may be substituted with an inset feed and/or a non-contact coupled connection to the antenna element 120.

Referring still to FIG. 1, embedded component subassembly 150 includes beamforming network components encapsulated within a molding material 152, together forming an embedded structure 154, which may sometimes be referred to as a reconstituted wafer. Subassembly 150 may further include one or more interconnect layers 155 (herein, interchangeably called "redistribution layers (RDLs)") formed (e.g., using a multi-step deposition process of dielectric and conductive materials) on the molding material 152 to electrically couple the beamforming network components to the antenna elements 120. Examples of such beamforming network components include integrated circuit (IC) chips 160, a transmission line section 180 that may form a combiner/divider network, and at least one RF feed-through transmission line 170. IC chips 160 may be monolithic microwave IC (MMIC) chips. In one example, IC chips 160 are each indium phosphide (InP). In another example, IC chips may be another semiconductor material such as gallium arsenide (GaAs), gallium nitride (GaN), etc. Any IC chip 160 may feed several antenna elements 120. (Herein, "feeding" an antenna element refers to transmitting a signal to an antenna element and/or receiving a signal from an antenna element.)

Hereafter, transmission line section 180 may be interchangeably referred to as combiner/divider network 180. In the transmit direction, combiner/divider network 180 functions as a divider that divides an RF transmit signal applied through transmission line 170 into a plurality of divided transmit signals, each applied to one of IC chips 160. In the receive direction, combiner/divider network 180 functions as a combiner that combines a plurality of receive signals each received by one or a group of antenna elements 120 and routed through (and typically modified by) an IC chip 160. Accordingly, IC chips 160 may collectively comprise an "RF front end" electrically coupled to antenna array 122. For transmitting signals, the RF front end may include power amplifiers for amplifying the RF signal applied through transmission line 170 in a distributed manner. In the receive direction, the RF front end may include low noise amplifiers, mixers, filters, switches and the like. If antenna array 122 is fed as a phased array, IC chips 160 may include phase shifters active in the transmit and/or receive paths for phasing antenna elements 120 with respect to each other, to thereby dynamically steer the antenna beam. In an example, a single coaxial feed-through transmission line ("coax feed-through") 170 may route the input RF signal on the transmit side and/or route a combined receive signal from all the antenna elements 120 on the receive side. In other cases, two or more coax feed-throughs 170 are provisioned, and additional dividing/combining of the transmit/receive signals is done at another layer of antenna apparatus 100, e.g. by dividing/combining signals to/from a plurality of coax feed-throughs 170. Coax feed-through 170 is an example of an input/output port of antenna apparatus 100. Other types of feed-throughs such as a CPW feed-through may be substituted.

Figure 3A:
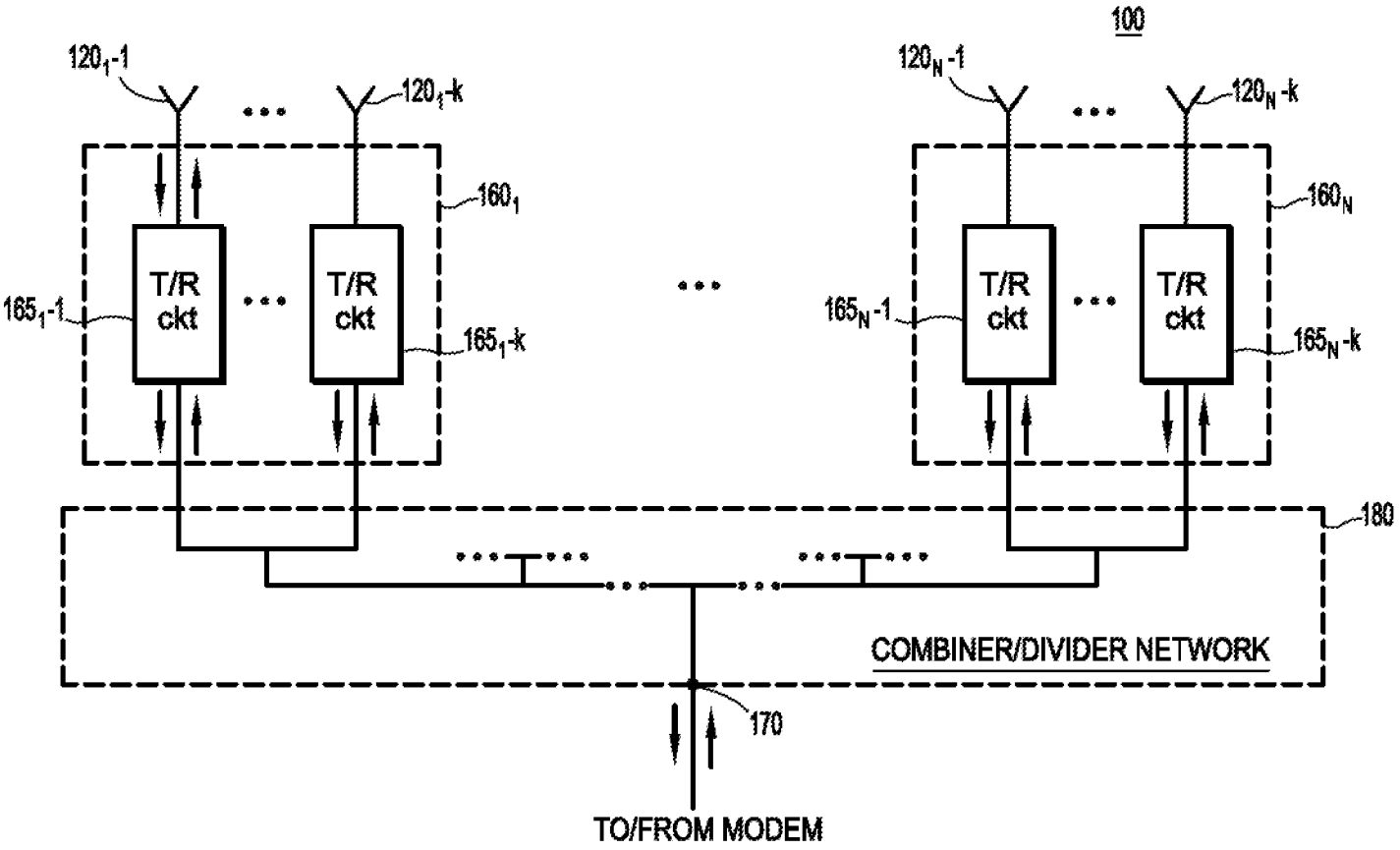
FIG. 3A schematically illustrates an example of antenna apparatus 100 configured as a phased array antenna for transmit and receive operations.

FIG. 3A schematically illustrates an example of antenna apparatus 100 configured as a phased array antenna for transmit and receive operations. Antenna apparatus 100 in this example includes N IC chips $\mathbf{160}_1$ to $\mathbf{160}_N$ and (N×k) antenna elements ($\mathbf{120}_1$-1 to $\mathbf{120}_1$-*k*), . . . , ($\mathbf{120}_N$-1 to $\mathbf{120}_N$-*k*), where each chip 160 is connected to k antenna elements 120, and the variables N and k are each two or more. (Note, however, that in certain other embodiments there may be only one antenna element 120 connected to each IC chip 160.) In the example of FIG. 1, it is seen that one IC chip 160 underlies (and connects to) four antenna elements 120, and thus k=4. Each IC chip $\mathbf{160}_i$ (i=any number from 1 to N) includes k transmit/receive (T/R) circuits $\mathbf{165}_i$-1 to $\mathbf{165}_i$-*k*. One end of any T/R circuit $\mathbf{165}_i$-*j* (j=any number from 1 to k) is connected to a respective antenna element $\mathbf{120}_i$-*j* and another end of T/R circuit $\mathbf{165}_i$-*j* is connected to a respective feed point of combiner/divider network 180. In the transmit direction, a transmit RF signal from feed-through 170 (e.g., provided from a modem) is divided by combiner/divider 180 into (N×k) signals, where each divided signal is fed to an individual T/R circuit 165, and modified (e.g., amplified, phase shifted and/or filtered) by the TR circuit 165. The modified signal of each T/R circuit 165 is output to a respective antenna element 120 to be radiated. In the receive direction, a receive signal received by each antenna element 120 is fed through each corresponding T/R circuit 165 and modified (e.g., amplified, filtered and/or phase shifted). Each modified receive signal is output to an input point of combiner/divider 180, which combines all the modified receive signals and provides a combined receive signal to feed-through 170.

Figure 3B:
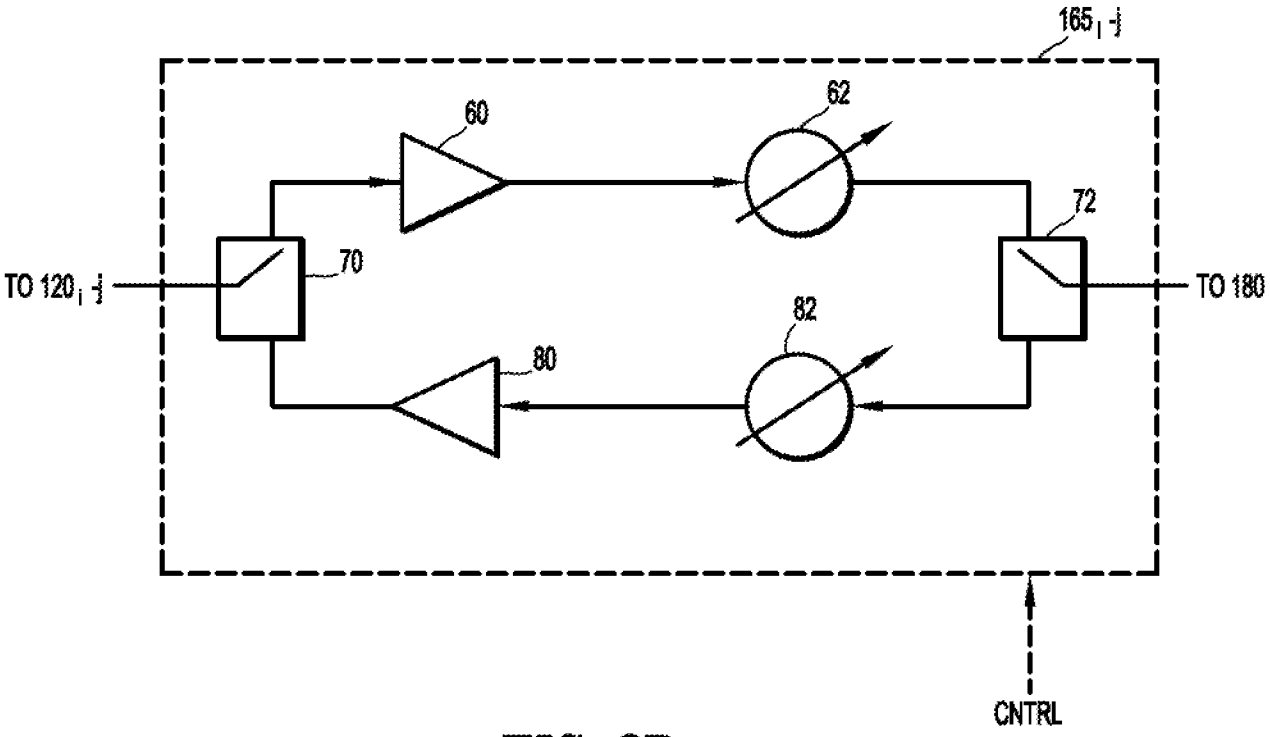
FIG. 3B schematically shows an example of a TR circuit of FIG. 3A.

FIG. 3B shows one example of a T/R circuit 165H that may be used for any of the T/R circuits 165 in antenna apparatus 100 of FIG. 12A. T/R circuit $\mathbf{165}_i$-*j* may include a pair of T/R switches 70, 72; a transmit path phase shifter 82; a transmit amplifier 80; a receive amplifier 60, and a receive path phase shifter 62. Control signals CNTRL may be applied to T/R circuit $\mathbf{165}_i$-*j* to control the switching states of T/R switches 70, 72, and may also dynamically control phase shifts of phase shifters 62, 82. During a transmit interval, T/R switches 70 and 72 are switched to first switch positions to route a transmit signal incident from combiner/divider network 180 through phase shifter 82 and amplifier 80 to antenna $\mathbf{120}_i$-j. During a receive interval, T/R switches 70 and 72 are switched to second switch positions to route an RF receive signal from antenna $\mathbf{120}_i$-*j* through amplifier 60 and phase shifter 62 to combiner/divider network 180. The same frequency band, or different frequency bands, may be used for transmit and receive operations.

T/R circuit $\mathbf{165}_i$-*j* of FIG. 3B is but one example of a T/R circuit that routes transmit and receive signals between shared antenna elements 120 (shared for handling both transmit and receive signals) and a shared combiner/divider network 180. Other configurations known to those of skill in the art may be substituted. For instance, an alternative T/R circuit may omit the T/R switches 70, 72 and utilize different frequency bands for transmit and receive operations, respectively, with a suitable isolation mechanism for preventing transmit signal power from damaging the receive amplifier 60. It may also be possible to omit T/R switches 70, 72 by implementing a polarization diversity scheme (e.g., left hand circular on transmit, right hand circular on receive, or vice versa).

Figure 2B:
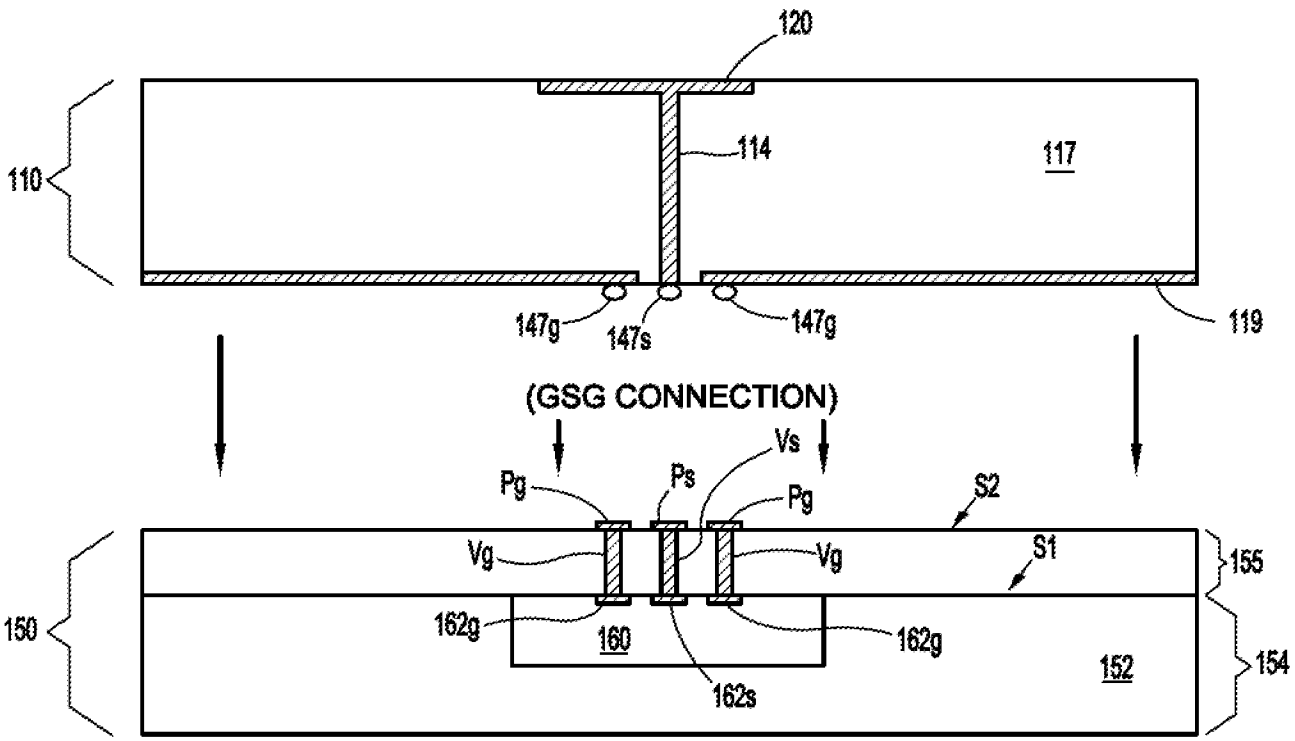
FIG. 2B is a cross-sectional view illustrating an example arrangement and connection technique between an antenna element and an IC chip of the antenna apparatus.

Returning to FIG. 2B, a cross-sectional view illustrating an example arrangement and connection technique between any antenna element 120 and an IC chip 160 of the antenna apparatus 100 is illustrated. IC chip 160 is embedded within embedded structure 154 and may have a signal line contact 162*s* and a pair of ground contacts 162*g* at or near a top surface S1 of embedded structure 154 for routing an RF signal. Conductive vias Vs, Vg formed within interconnect layer 155 each have a respective end connected to contacts 162*s*, 162*g* and an opposite end having respective contact pads Ps, Pg. In an assembly stage, antenna subassembly 110 may be attached to subassembly 150 by adhering a lower surface of ground plane 119 to a top surface S2 of interconnect layer 155. Such attachment may be realized with an electrical bonding material, e.g., solder, between respective pads on subassemblies 110, 150, and optionally supplemented using an adhesive on other surface regions of subassemblies 110, 150. During this assembly stage, pad Ps may be soldered to the microstrip probe feed 114 through a solder ball (or bump/pillar) 147*s* melted and then cooled during the adhering process. Likewise, the pair of pads Vg may be soldered to ground plane 119 through a respective pair of solder balls 147*g*, thereby forming a ground-signal-ground (GSG) connection between feed 114/ground plane 119 and the signal/ground points of IC chip 160. The solder balls 147*s*, 147*g* may have been initially adhered to the antenna feed/ground plane 114/119 as illustrated in FIG. 2B, or alternatively to the pads Ps, Pg.

In the shown embodiment, with the IC chip 160 directly underlying antenna element 120, the vias Vs, Vg form desirable short connections between IC chip 160 and the antenna element 120 contact points. In other embodiments where an IC chip 160 does not directly underlay an antenna element 120, the GSG connection may be made to points of a coplanar waveguide (CPW) transmission line within interconnect layer 155. Such a CPW transmission line may have an inner trace extending to pad Ps and a pair of ground traces (one on each side of the inner trace) respectively extending to the pair of pads Pg.

Figure 4:
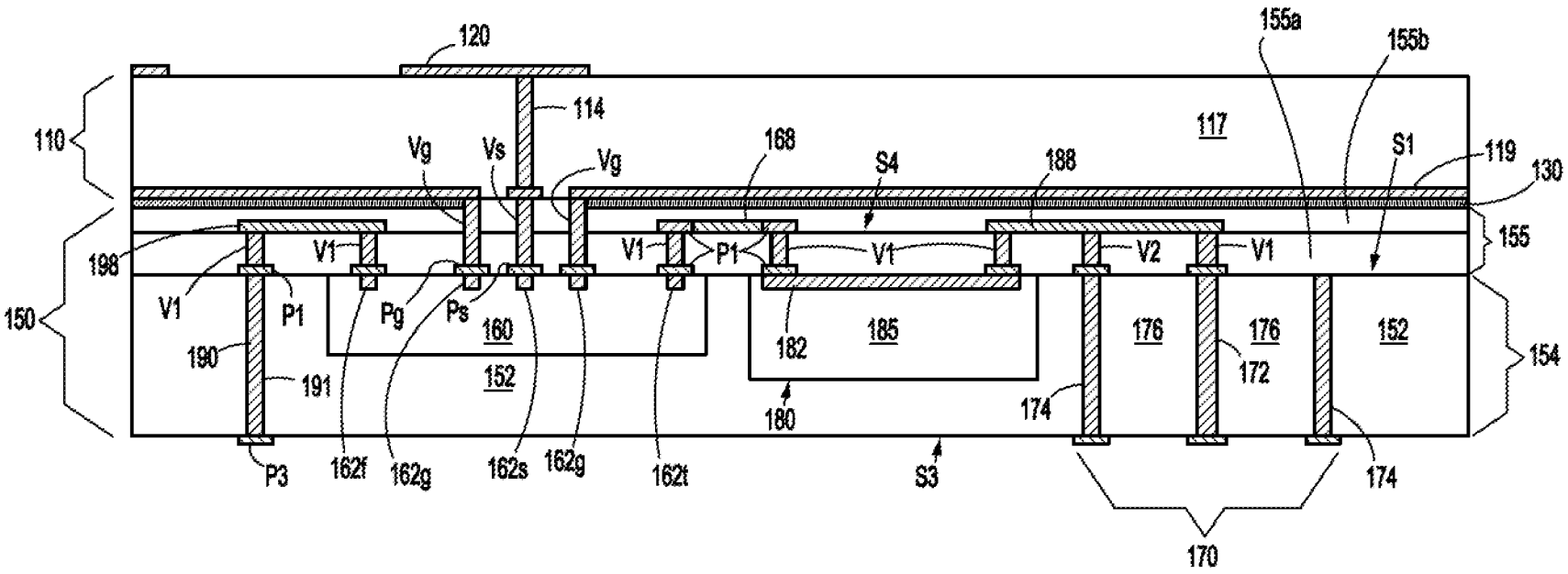
FIG. 4 is a cross-sectional view of a portion of the antenna apparatus taken along the lines IV-IV of FIG. 1.

FIG. 4 is a cross-sectional view of a portion of antenna apparatus 100 taken along the path IV-IV' of FIG. 1. In this example cross section, embedded component subassembly 150 includes an IC chip 160, a transmission line section 180, a coaxial line ("coax") feed-through 170, and a DC via 190. IC chip 160 may be connected to one or more antenna elements 120 of subassembly 110 in the manner described above for FIG. 2B. An insulating adhesive layer 130 may be formed between the subassemblies 110, 150 following the above-discussed adhesion stage. Adhesive layer 130 is present if an adhesive is applied to supplement electromechanical attachment of subassemblies 110, 150 using the GSG solder connections; otherwise, adhesive layer 130 may be omitted. In the shown example, the one or more RDL layers 155 comprise a lower RDL layer 155*a* and an upper RDL layer 155*b*, where upper RDL layer 155*b* separates conductive traces such as 198, 168, and 188 and the adhesive layer 130/ground plane 119. In an alternative design, upper RDL layer 155*b* is omitted, such that only the adhesive layer 130 separates the ground plane 119 and the conductive traces atop the RDL layer 155*a*.

IC chip 160, transmission line section 180, and coax feed-through 170 are each an example of a beamforming network component that was embedded within molding material ("encapsulant") 152, and each may have an upper surface substantially coplanar with an upper surface s1 of encapsulant 152. RDL layer connections between these elements may be made through respective vias V1 extending from surface al to an upper surface s4 of RDL layer 155*a*. Any via such as V1, Vg or 190 may have a barrel (e.g. barrel 191 of via 190) extending through the surrounding dielectric material, and a pair of pads, e.g., P1, P3, Pg, Ps on opposite ends. For instance, IC chip 160 may have contact 162*f* connected to a via V1, which in turn connects to conductive trace 198, another via V1 and DC via 190. DC via 190 may extend to a lower surface s3 of encapsulant 152, where its opposite end has a lower pad P3. Conductive traces 198, 168, 188 patterned along surface s4 may interconnect beamforming components through connection to the via pads. Any via pad formed atop surface s1 of encapsulant 152 may be formed prior to applying a layer of dielectric to form RDL layer 155*a*. After the RDL layer 155*a* dielectric is applied, the opposite pad of the via may be formed, and thereafter a via hole may be drilled through the top pad and extending through to the lower pad. The via hole may be then be filled with a conductor, e.g., electroplated, to complete the via formation.

Coplanar waveguide (CPW) connections may also be made between various components through RDL layers 155 to form interconnects to route RF signals. For example, transmission line section 180 may include conductive traces such as inner CPW trace 182 extending along a top surface of a low loss dielectric material 185 such as quartz or fused silica. Dielectric material 185 is desirably a material having a lower loss tangent than that of encapsulant 152. Outer CPW traces, not shown in FIG. 4, discussed later as traces 184*a*, 184*b* of FIG. 5, may extend parallel to inner trace 182 on opposite sides thereof. (In the cross-sectional view of FIG. 4, one CPW outer trace may be in front of inner trace 182 while the other outer trace is behind inner trace 182.) One end of inner trace 182 may connect to a signal contact 162*t* of IC chip 160 through an interconnect formed by RDL trace 168 between a pair of vias V1. Likewise, a pair of outer RDL traces (not shown) may connect the outer CPW traces of transmission line section 180 to a pair of ground contacts of IC chip 160 (not shown in FIG. 4 but exemplified as contacts 162*g* in FIG. 5) on opposite sides of signal contact 162*t*.

Coaxial line 170 is comprised of a dielectric 176 such as glass separating an inner conductor 172 and an outer cylindrical conductor 174. Coaxial line 170 may extend vertically from surface s1 to lower surface s3 of encapsulant 152. Inner conductor 172 may connect to another end of inner CPW trace 182 through an interconnect comprising RDL trace 188 between a pair of vias V1. Outer conductor 174 may connect at two points to outer traces on opposite sides of inner trace 182. For instance, a via V2 may be formed behind inner CPW RDL trace 188 in the cross-sectional view of FIG. 4. This via V2 may electrically connect a point of outer conductor 174 to one of the RDL outer CPW traces located behind inner CPW RDL trace 188. Coax feed-through 170 and DC via 190 may each connect to a surface mount connector (not shown) at surface s3. One or more additional IC chips may be mounted to surface s3 and connected to IC chips 160 through additional vias as desired. One example of such an additional IC chip is a voltage regulator chip providing voltage to IC chip 160. Another example is a microprocessor chip that provides control signals to beamforming circuitry such as phase shifters and/or T/R switches within IC chip 160.

Figure 5:
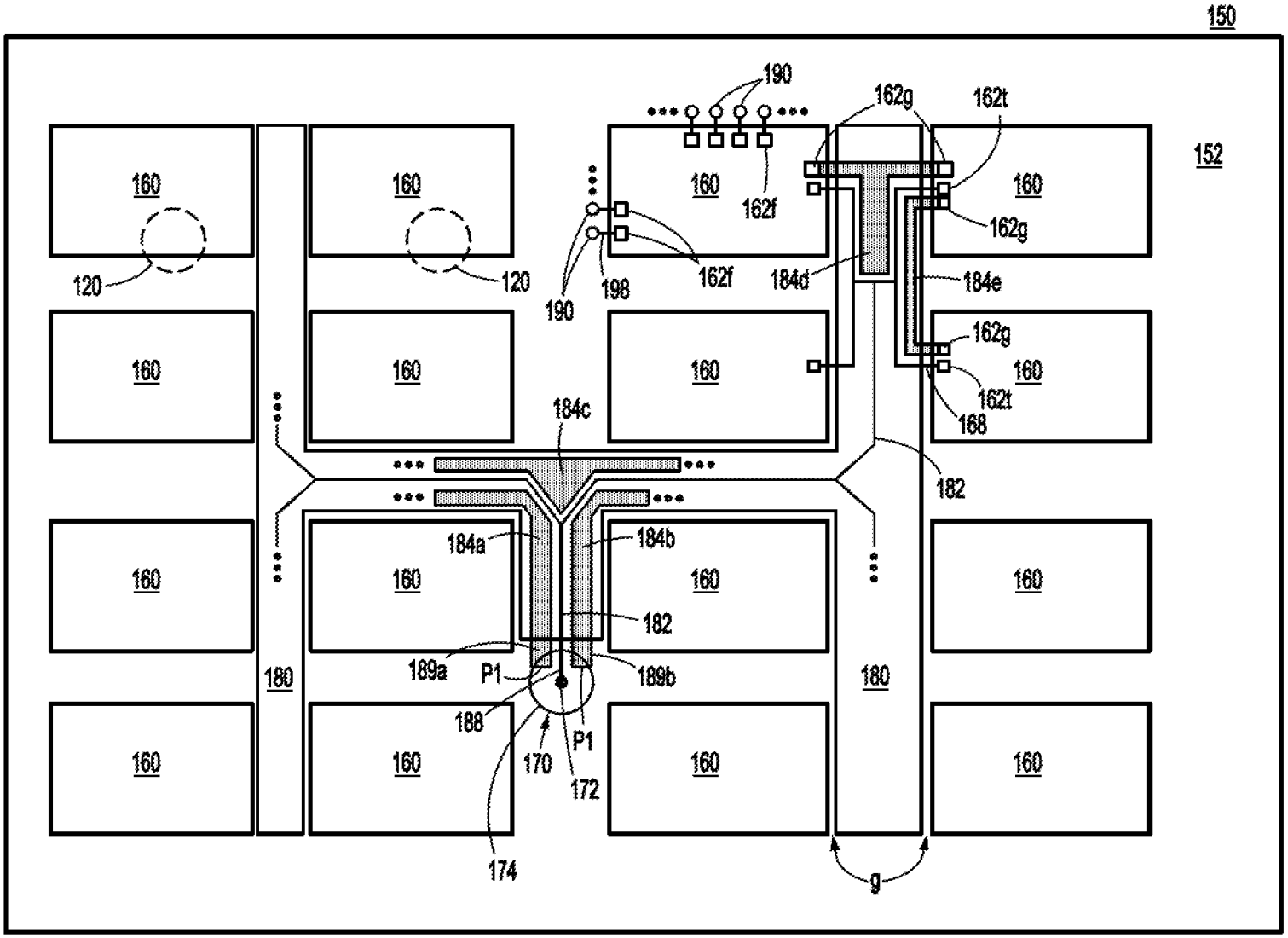
FIG. 5 is a plan view of an example embedded component subassembly of the antenna apparatus.

FIG. 5 is a plan view of an example embedded component subassembly 150 of antenna apparatus 100. Subassembly 150 may include IC chips 160 laid out in a planar grid arrangement. A transmission line section 180 is disposed in spaces ("streets") between some of IC chips 160. While transmission line section 180 is depicted as a single section, it may be composed of multiple sections interconnected to one another through interconnects in RDL layer 155. Gaps "g" may separate edges of transmission line section 180 from adjacent sides of IC chips 160. In some cases, a minimum gap g size is allocated to account for thermal expansion. A small gap g is generally desirable, but the gap size may be primarily driven by manufacturing limitations. A plurality of vias 190 may be disposed adjacent to one or more edges of each IC chip 160. Each via 190 may connect to a respective contact 162*f* of the adjacent IC chip 160 through an RDL interconnect 198 to route a DC bias signal or a control signal to/from that IC chip 160. For instance, a DC bias signal(s) may bias a transmit direction power amplifier and/or a receive direction low noise amplifier (LNA) of an IC chip 160. Control signals may dynamically control phase of phase shifters within IC chips 160.

An IC chip 160 may have a rectangular profile. At least some of IC chips 160 may directly underlay portions of several antenna elements 120, enabling short connections to probe feeds 114 to be made through vias. For instance, signal contacts 162*f* of IC chips 160 may directly underlie respective vias in interconnect layer 155 that in turn directly underlie probe feeds 114. A majority portion of each antenna element 120 (e.g., a portion including a probe feed point) may overlay a respective portion of an IC chip 160. Some of the antenna elements 120 may have a majority portion overlaying a corner of an IC chip 160, with a minority portion situated outside the perimeter of the IC chip 160.

A coax feed-through 170 with inner conductor 172 and outer conductor 174 may route an input RF signal to some or all of IC chips 160 through transmission line section 180. As described for FIG. 4, inner conductor 172 may connect to a proximal end of inner CPW trace 182 through RDL interconnect 188. Additionally, first and second CPW outer traces 184*a*, 184*b* may connect to outer conductor 174 at separate points through respective pads P1 and RDL interconnects 189*a*, 189*b* in RDL layer 155. A divider network (on transmit) may be formed by splitting inner CPW trace 182 into multiple paths as illustrated in FIG. 5 to divide signal energy of an RF transmit signal, and by providing additional CPW outer traces such as traces 184*c*, 184*d* and 184*e*. A power amplifier within each IC chip 160 may amplify the portion of the split RF signal before routing to antenna elements 120. With suitable transmit/receive (TR) switching, the same CPW conductive traces may be used as a combiner network in the receive path to combine RF receive signals received by antenna elements 120 and amplified by low noise amplifiers (LNAs) within IC chips 160. The CPW outer traces may each be connected to a ground contact 162*g* within an adjacent IC chip 160 by means of an RDL interconnect. Likewise, distal ends of inner CPW trace 182 may each connect to a signal contact 162*t* in a respective one of IC chips 160 through an RDL interconnect 168 (see FIG. 4).

Figure 6:
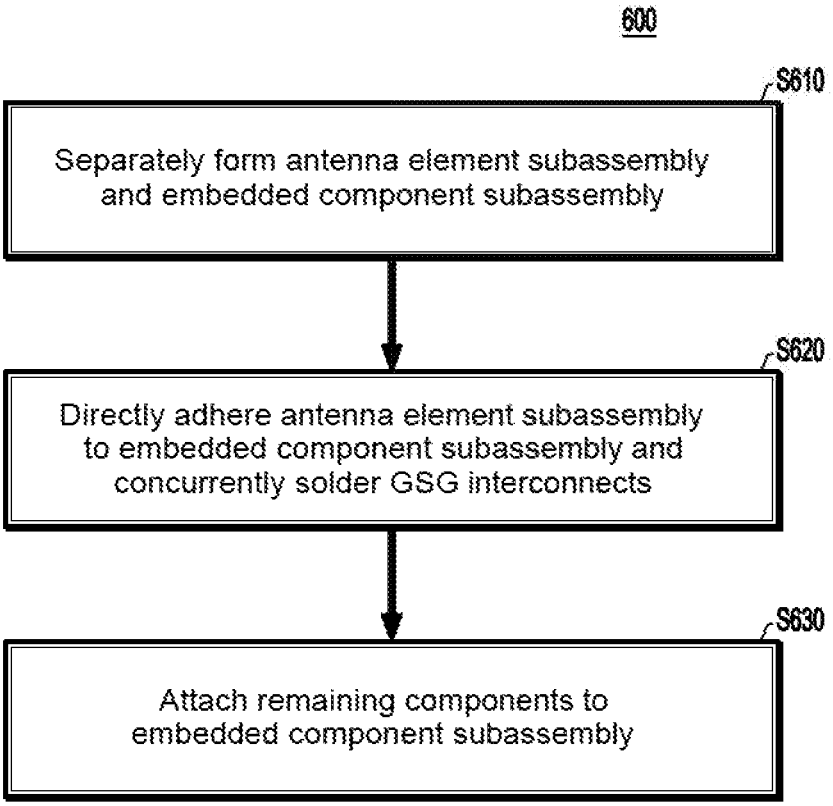
FIG. 6 is a flow diagram depicting an example method for fabricating an antenna apparatus.

FIG. 6 is a flow diagram depicting an example method, 600, for fabricating antenna apparatus 100. Initially, antenna element subassembly 110 and embedded component subassembly 150 may be separately formed (block S610). For instance, antenna element subassembly 110 may be formed by first pre-cutting a slab of low loss dielectric 117, e.g., quartz or fused silica, to a desired profile of antenna apparatus 100. Thereafter, the lower major surface of dielectric 117 may be patterned with ground plane 119 except for circular regions surrounding locations for each probe feed 114. Pads for probe feeds 114 may then be formed on the lower surface within the circular regions, and via holes drilled through the pads. The via holes may be thereafter electroplated to form the probe feeds 114 embodied as vias. Note that ground plane 119 may be formed either before or after formation of the probe feeds 114. Antenna elements 120 may then be formed on the upper major surface of dielectric 117 by pattern metallization at regions coinciding with the probe feed 114 locations, thus completing the antenna element subassembly 110. In alternative sequence, antenna elements 120 are formed prior to processes for forming probe feeds 114 and/or ground plane 119. Embedded component subassembly 150 may be formed in the manner described below in connection with FIG. 7. GSG solder balls may be attached to the GSG contacts of either subassembly 110 or 150.

Next, antenna component subassembly 110 may be directly adhered (S620) to embedded component subassembly 150 while the GSG solder balls are concurrently melted and cooled to form the GSG interconnects between the two subassemblies, as discussed for FIG. 2B. (As noted above, the GSG solder connections may serve as the entire mechanical connection in some embodiments, without a supplemental adhesive.) Remaining components may then be attached (S630) to embedded component subassembly 150. These may include the above-noted surface mount coaxial connector and DC connector, as well as ICs mounted to the lower surface s3 of encapsulant 152.

Figure 7:
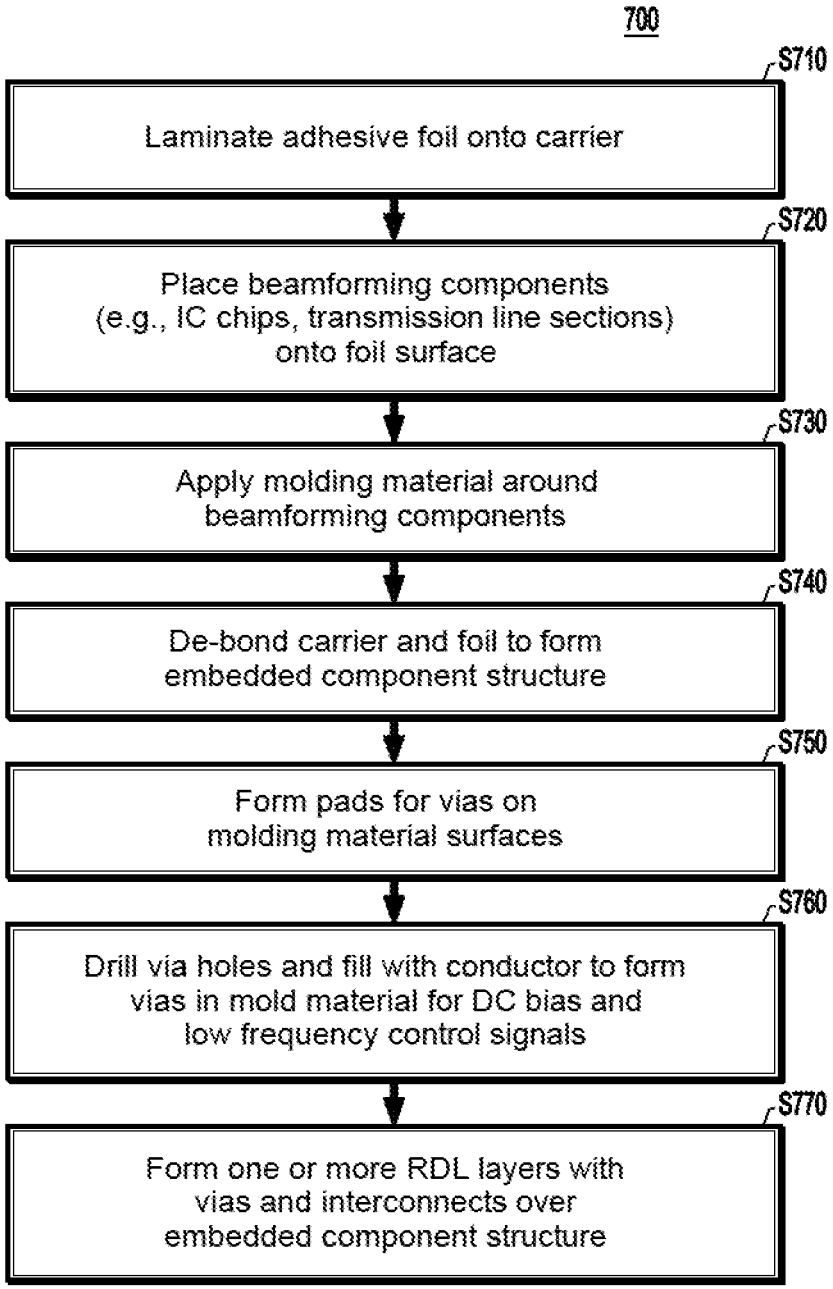
FIG. 7 is a flow diagram of an example method of forming the embedded component subassembly.

FIG. 7 is flow diagram of an example method, 700, of forming embedded component subassembly 150, and FIGS. 8A-8G are cross-sectional views illustrating structures corresponding to respective steps in method 700. In an initial step S710, an adhesive foil 810 (see FIG. 8A) is laminated onto a carrier plate 820, thus forming a carrier assembly 830. Beamforming components may then be placed (S720) onto the foil using a pick and place tool (see FIG. 8B). The beamforming components may include e.g. IC chips 160, transmission line sections 180 (e.g., quartz sections with or without CPW conductive traces 182, 184 already formed), one or more RF feed-throughs, e.g., coax feed-through 170, and other IC chips (not shown) of different functionality/material/sizes than IC chips 160. Some of the beamforming components, e.g., any of IC chips 160, may have had a heat spreader tab attached thereto prior to placement on adhesive foil 810 (e.g., heat spreader tab 1102 of FIG. 11B, discussed later).

Figure 8A:
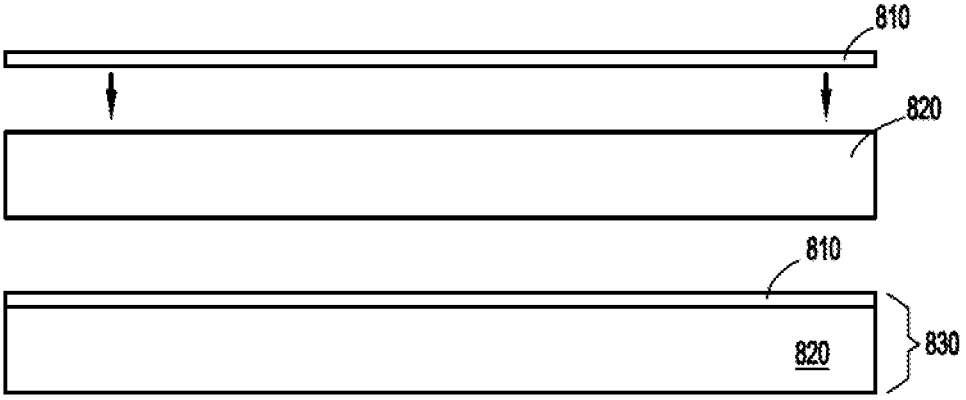
FIGS. 8A, 8B, 8C, 8D, 8E, 8F and 8G are cross-sectional views illustrating respective steps in the method of forming the embedded component subassembly of FIG. 7.
Figure 8B:
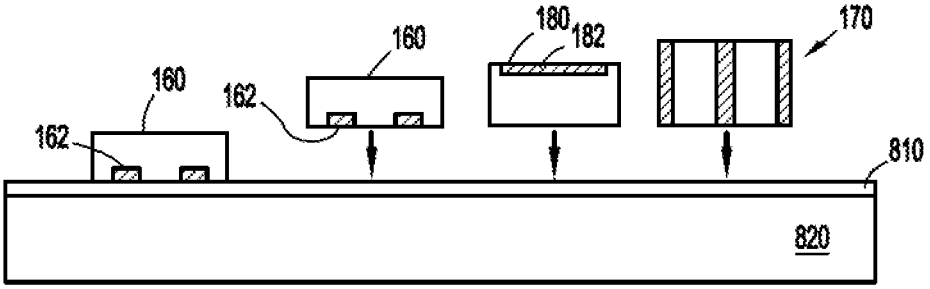
Figure 8C:
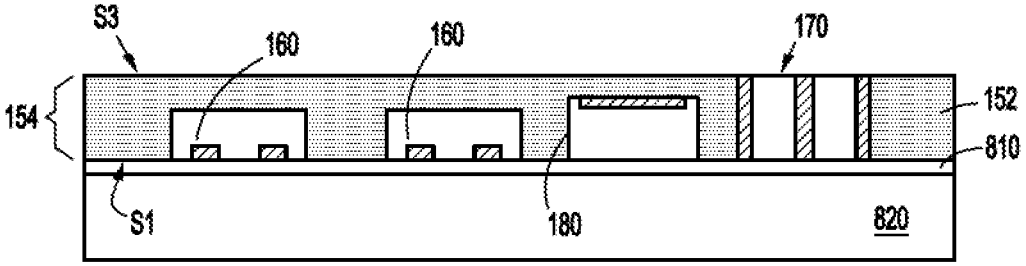

Molding material 152 may then be applied (S730) in a non-cured state (liquid or pliable) on the surface of the adhesive foil around the beamforming components, and over the surfaces of at least some of the beamforming components using a mold press. Examples of molding material 152 include an epoxy molding compound, liquid crystal polymer (LCP) and other plastics such as polyimide. Here, molding material 152 may be applied at a thickness of at least the height of the tallest component with respect to the foil surface, e.g., coax feed-through 170. Molding material 152 may then be cured and optionally trimmed/planarized to form an interim structure with an embedded component structure 154 as depicted in FIG. 8C. In this manner, embedded component structure 154 may be formed as a wafer-like structure with substantially planar opposing major surfaces s1, s3, and may be further processed like a wafer.

Figure 8D:
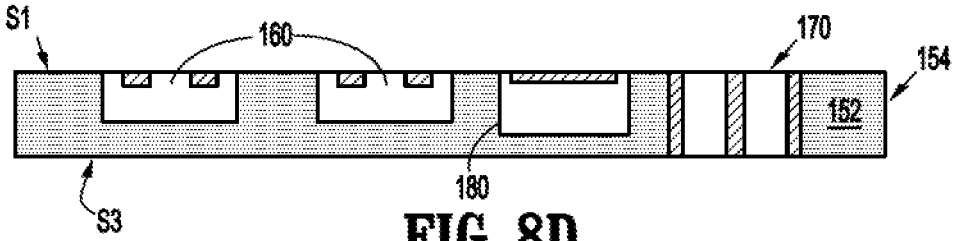
Figure 8E:
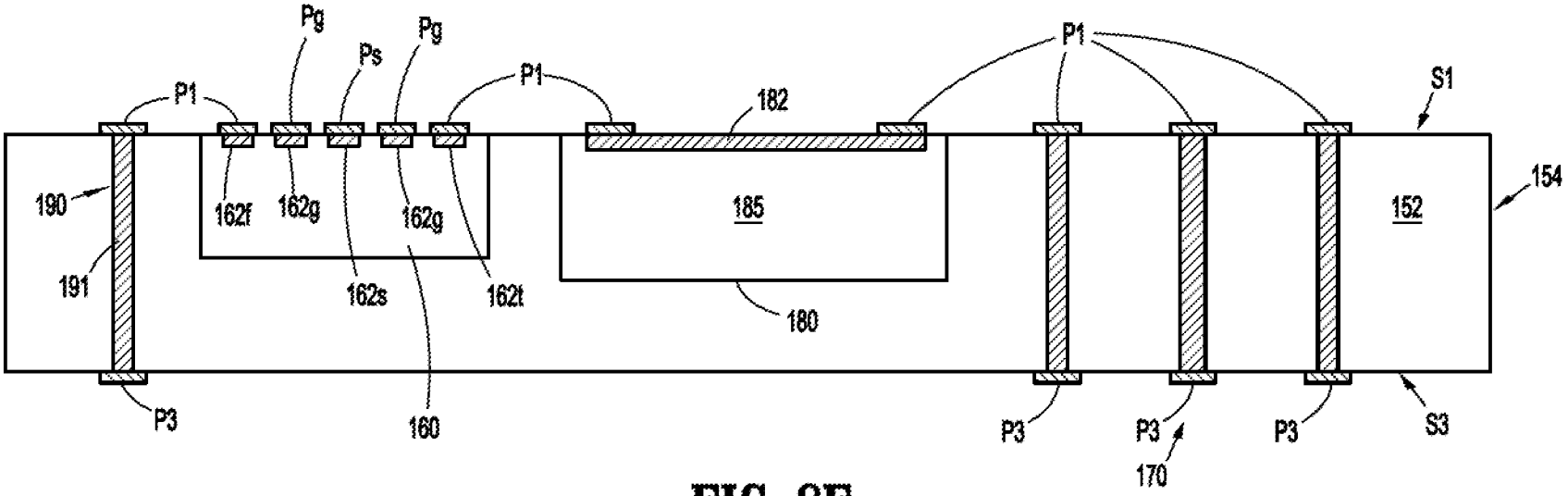

In a following step (S740) the carrier 820 and foil 810 may be removed from the interim structure by de-bonding from embedded structure 154 using a de-bonding tool, and embedded structure 154 may be flipped around as seen in FIG. 8D. (Note that in FIG. 8D, if a heat spreader tab is attached to an IC chip 160, the tab's thickness may have been preset, or later trimmed, so that the tab's lower surface is coplanar with the surface s3 of molding material 152.) Pads may thereafter be formed (S750) on the opposing surfaces s1 and s3 of the structure 154 in locations at which vias are to be formed or where electrical contacts to other components are to be made. As seen in FIG. 8E, pads P1, Ps and Pg for forming parts of subsequent vias through the interconnect layer 155 are formed on top surface s1 through pattern metallization. During this processing stage, if transmission line section 180 was embedded without the CPW conductive traces 182, 184, they may be concurrently formed by pattern metallization when pads P1, Ps, Pg are formed. Pads P3 for forming part of a via (e.g. 190) through molding material 152 and/or for connection to other components may also be formed on the lower surface s3. Via holes may be drilled through pads and molding material 152 and filled with conductive material (S760), e.g. by electroplating, to form completed vias (e.g. 190). Note that as an alternative to providing coax feed-through 170 as a single component prior to the embedding process, it may be formed at this processing stage using multiple, separate embedded components.

Figure 8F:
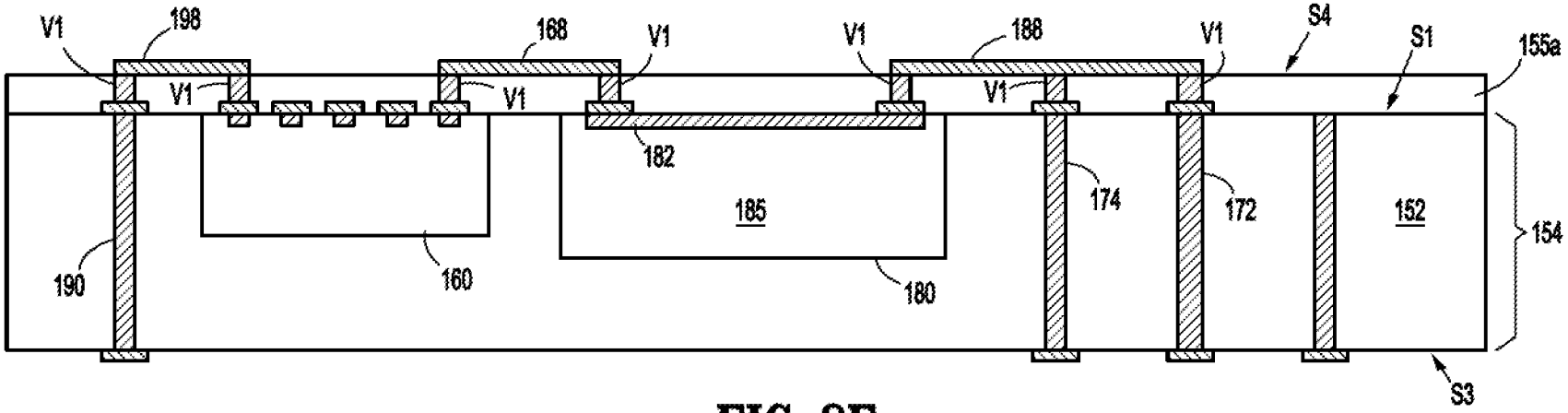
Figure 8G:
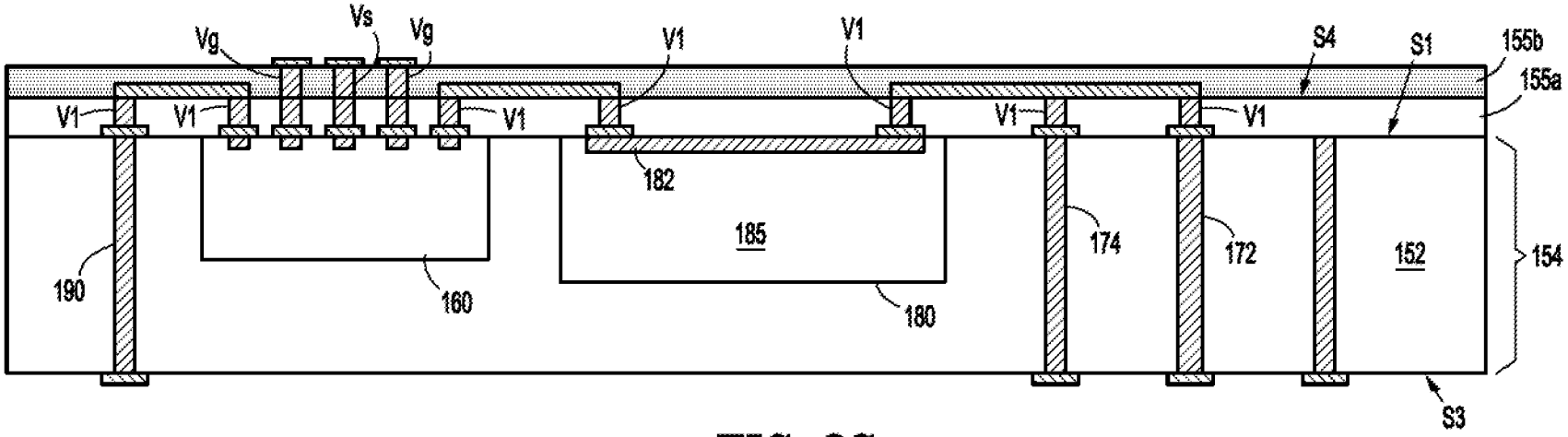

One or more RDL layers 155 with vias and interconnects may then be formed (S770) over embedded component structure 154. For instance, in a design with first and second RDL layers 155*a*, 155*b*, first RDL layer 155*a* may first be formed atop surface s3 of embedded structure 154, as illustrated in FIG. 8F. Subsequent steps may form vias V1 through layer RDL layer 155*a*, and conductive traces such as 198, 168 and 188 formed on surface s4 of RDL layer 155*a* to complete interconnections between beamforming components. Afterwards, second RDL layer 155*b* may be formed on the top surface s4 of first RDL layer 155*b*. Vias Vg and Vs, which extend through both the first and second RDL layers 155*a*, 155*b*, may then be formed. In an alternative sequence, a lower portion of each via Vs and Vg may first be formed when the vias V1 are formed, i.e., prior to the formation of second RDL layer 155*b*. An upper portion of vias Vs and Vg may thereafter be formed after second RDL layer 155*b* is applied.

Figure 9:
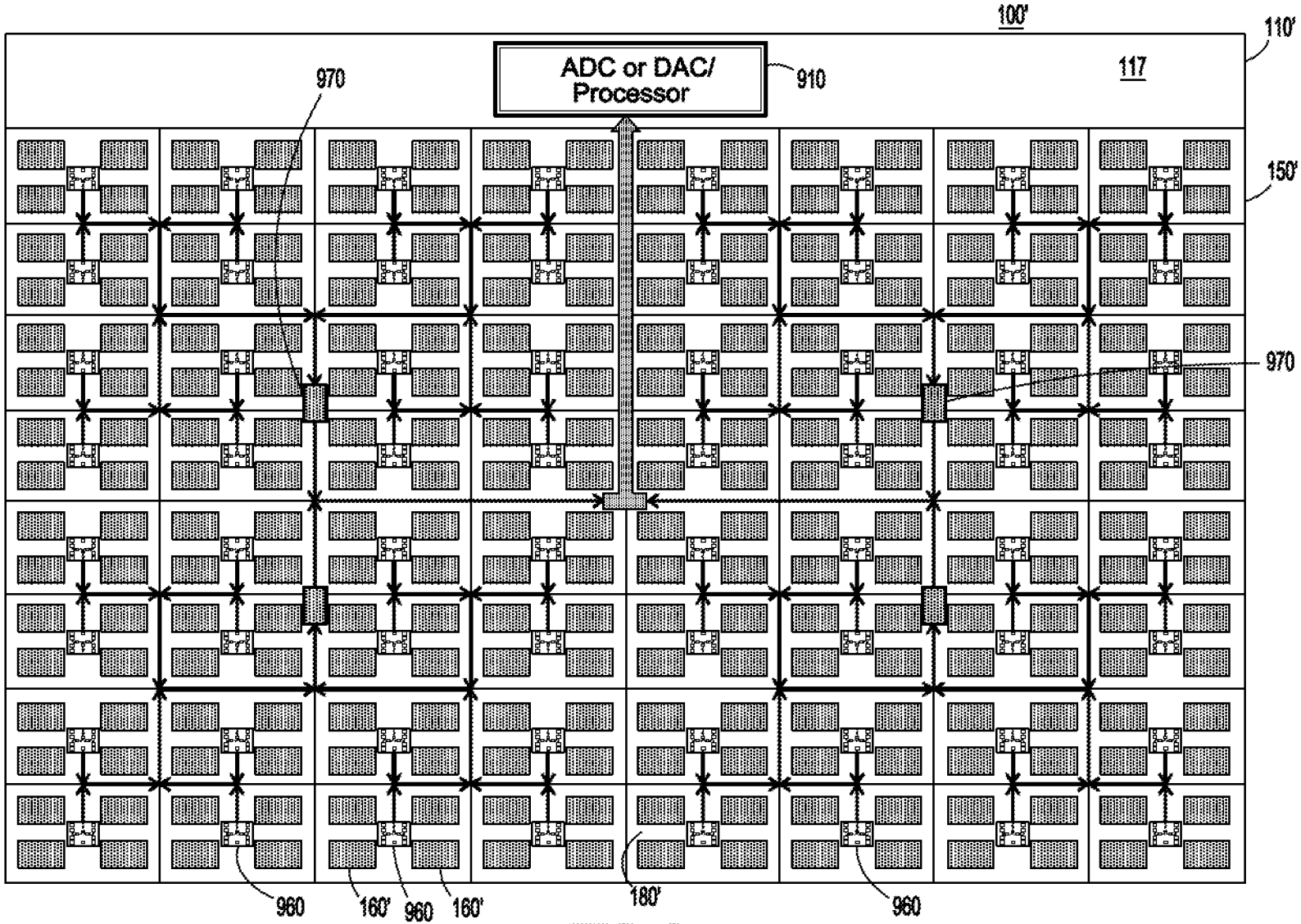
FIG. 9 is a plan view of another example embedded component subassembly of an antenna apparatus.

FIG. 9 illustrates a partial layout of another example antenna apparatus 100' in accordance with another embodiment. Antenna apparatus 100' may include an antenna subassembly 110' adhered to an embedded component subassembly 150'. Antenna subassembly 110' may be of substantially the same construction as antenna subassembly 110, but with an extended dielectric portion 117 upon which an ADC/DAC/processor 910 is attached or embedded. Alternatively, ADC/DAC/processor 910 is attached to or embedded within an extended portion of subassembly 150' and dielectric portion 117 may not be extended. Subassembly 150' may include embedded IC chips 160' and embedded IC chips 960 interconnected with one another through at least one interconnect layer 155 of similar or identical construction as that described above. IC chips 960 may be have different functionality than IC chips 160' and/or may be composed of different semiconductor material. In an example, IC chips 160' include InP transistors (e.g., power amplifiers, low noise amplifiers, etc.) whereas IC chips 960 include silicon or SiGe based transistors (e.g., beamforming elements such as phase shifters, etc.). IC chips 160' may include RF power amplifiers and may be directly connected to antenna elements 120 of antenna subassembly 110' through vias in the at least one interconnect layer 155 in the manner described earlier for IC chips 160. IC chips 960 may be connected to antenna elements 120 through extended signal paths.

In one example, IC chips 960 include receiver front end circuitry, e.g., low noise amplifiers (LNAs), bandpass filters, phase shifters, etc., that connect to antenna elements 120 through conductive traces within IC chips 160' and/or within the one or more interconnect layers 155. In this case, the receiver circuitry within a given IC chip 960 may modify (e.g., amplify, phase shift and/or filter) one or more receive signals routed from one or more antenna elements 120 and output the modified receive signal to combiner/divider network 180' disposed between IC chips 160' and between IC chips 960. IC chips 960 may also or alternatively include a vector generator. IC chips 970, e.g. modems, may also be embedded within embedded component subassembly 150' and may be coupled between ADC/DAC/processor 910 and IC chips 960 and 160'.

Figure 10:
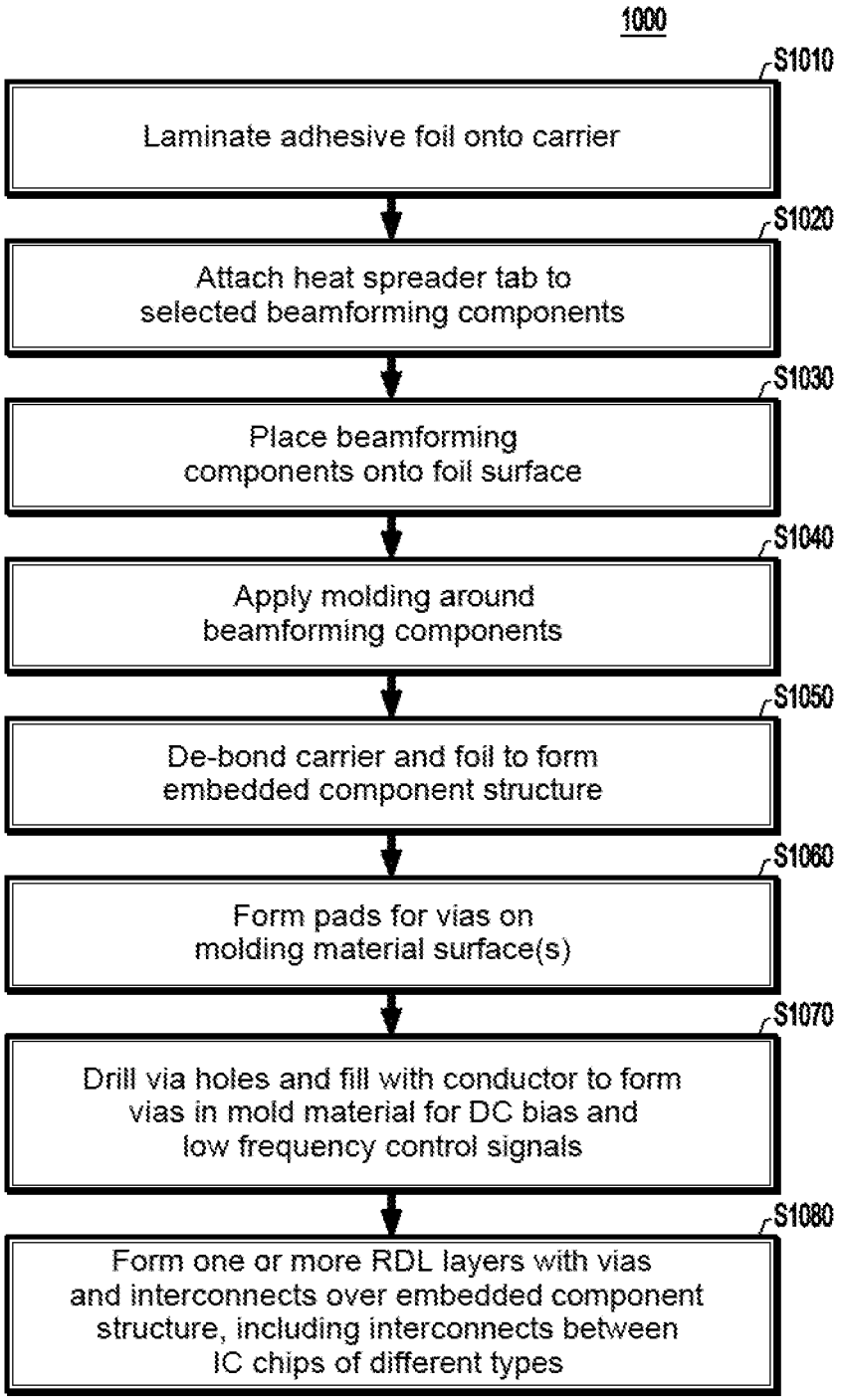
FIG. 10 is a flow diagram of another example method of forming the embedded component subassembly.

FIG. 10 is a flow diagram of a method, 1000, of fabricating an embedded component subassembly 150 or 150' with heat spreader tabs integrated with at least some of the embedded beamforming components. FIGS. 11A-11E are cross-sectional views illustrating structures corresponding to respective steps in method 1000. In method 1000, an adhesive foil 810 may be laminated (S1010, FIG. 11A) onto a carrier 820 to form a carrier assembly 830. Heat spreader tabs may be attached (S1020) to surfaces of selected beamforming components, e.g., heat spreader tabs 1102 attached to IC chips 160' in FIG. 11B. The thickness and profile of the heat spreader tabs may be chosen based on an estimate of the heat generated by the attached beamforming component, its desired operating temperature range, and the heat dissipating characteristics of the heat spreader tab.

Figure 11A:
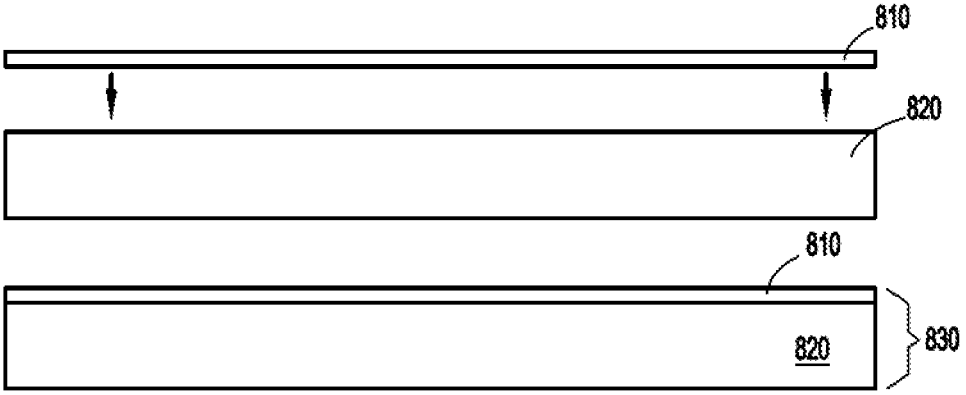
FIGS. 11A, 11B, 11C, 11D and 11E are cross-sectional views illustrating respective steps in the method of forming the embedded component subassembly of FIG. 10.
Figure 11B:
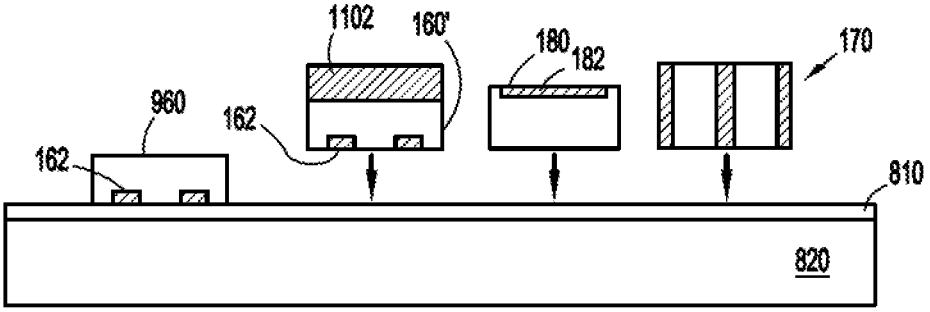
Figure 11C:
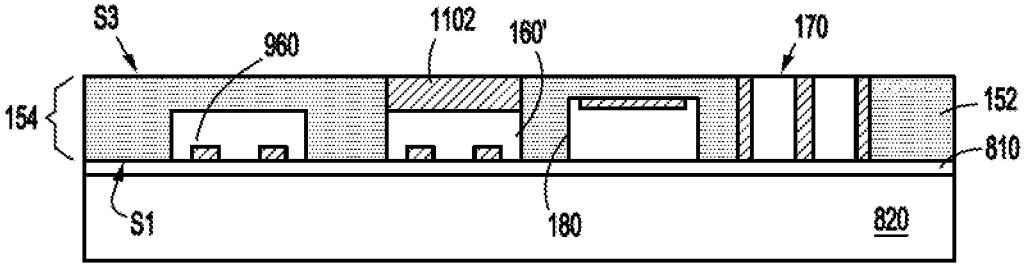
Figure 11D:
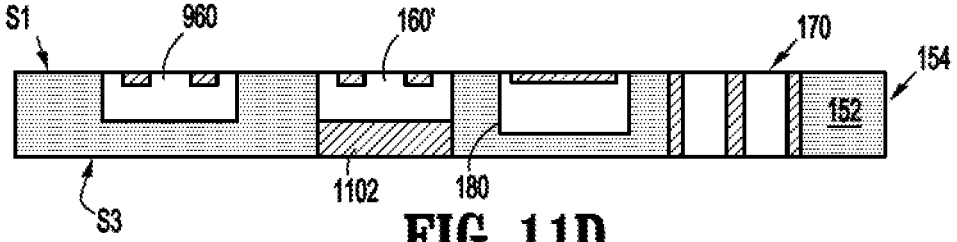

Beamforming components (including those with heat spreader tabs 1102 attached) may then be placed onto the foil 810 surface (S1030, FIG. 11B). Molding material 152 may then be applied around the beamforming components (S1040, FIG. 11C) and cured. The molding material 152 may be trimmed as necessary to expose a surface of heat spreader tab 1102, e.g., so the exposed tab 1102 surface is coplanar with a major surface s3 of molding material 152. If other beamforming components such as coax feed-through 170 are taller than beamforming components with attached heat spreader tabs (where height is measured from the foil surface 810), the heat spreader tabs may be pre-designed with a thickness such that surface s3 is coplanar with both the heat spreader tab's exposed surface and an exposed surface of the tallest beamforming component (e.g. 170), as seen in FIG. 11C. Alternatively, the heat spreader tab and/or coax feed-through 170 are trimmed in a later planarizing process of surface s3. In this manner, the resulting embedded component structure 154 may be wafer-like with opposing major surfaces that are both substantially flat.

Figure 11E:
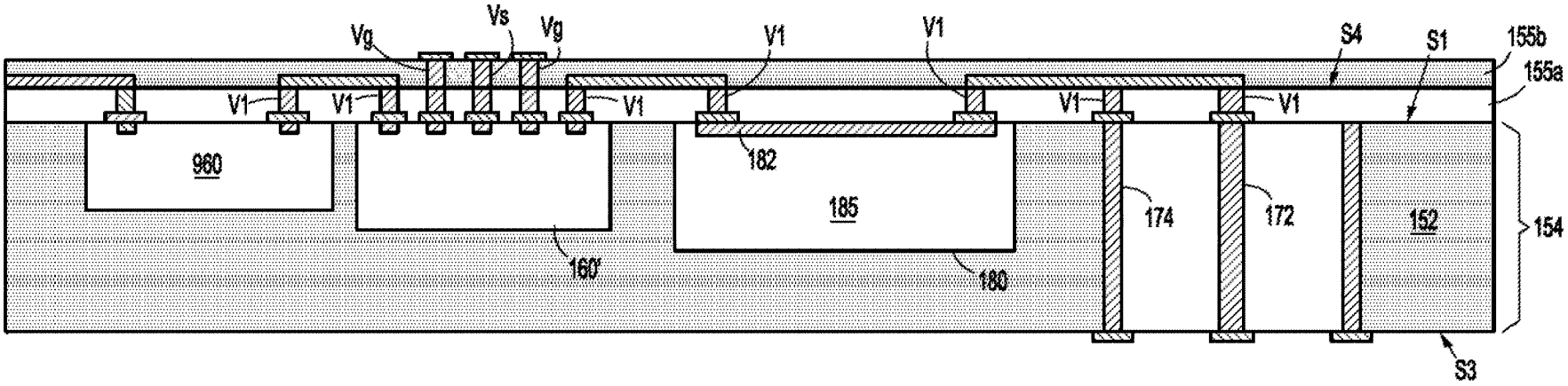

Subsequently, the carrier and the foil may be de-bonded from the embedded components and molding material (S1050) resulting in a wafer-like embedded component structure 154 (FIG. 11D) with opposing surfaces s1 and s3. One major surface of each beamforming component may be coplanar with surface s1. Pads for vias may then be formed (S1060) on surface s1, and also on surface s3 if vias are to be formed through molding material 152. Via holes may be drilled through the pads (S1070) and filled with conductive material to form vias in the molding material for DC bias and low frequency control signals. One or more interconnect layers 155 with vias and interconnects may then be formed (S1080) over the embedded component structure 154, as illustrated in FIG. 11E. Note that vias 190, although not shown in FIGS. 11A-11E, may be formed in embedded component subassembly 150' and connected to IC chips 160', 960 and/or 970 in the same manner as described above for subassembly 150. In the example of FIG. 11E, an IC chip 160' electrically connects to an IC chip 960 through an interconnect comprising a signal trace 998 between a pair of vias V1. As in the previous example of FIGS. 8A-8G, a single interconnect layer, or three or more interconnect layers, may be substituted for the pair of RDL layers 155*a*, 155*b* in alternative design examples.

Embodiments of antenna apparatus as described above may be formed with a low profile and may therefore be particularly advantageous in constrained space applications. Further, the construction is amenable for including low loss elements, e.g., low loss transmission lines and antenna substrates, which may be particularly beneficial at millimeter wave frequencies.

While the technology described herein has been particularly shown and described with reference to example embodiments thereof, it will be understood by those of ordinary skill in the art that various changes in form and details may be made therein without departing from the spirit and scope of the claimed subject matter as defined by the following claims and their equivalents.

What is claimed is:

1. Antenna apparatus comprising:

a first subassembly comprising a plurality of antenna elements; and a second subassembly adhered to the first subassembly, the second subassembly comprising a plurality of components of a beamforming network encapsulated within a molding material, and further comprising interconnect layers on the molding material to electrically couple the plurality of components of the beamforming network to the plurality of antenna elements;

wherein the plurality of components includes a plurality of amplifiers coupled to the plurality of antenna elements through a plurality of vias within the interconnect layers.

2. The antenna apparatus of claim 1, wherein surfaces of the plurality of components of the beamforming network are co-planar with a surface of the molding material.

3. The antenna apparatus of claim 1, wherein the plurality of antenna elements are on a first surface of the first subassembly, and the first subassembly further comprises an array of vias directly connected to the plurality of antenna elements and extending to a second surface of the first subassembly, wherein the second subassembly is adhered to the second surface of the first subassembly.

4. The antenna apparatus of claim 1, wherein an amplifier of the plurality of amplifiers is coupled to and underlies a corresponding antenna element of the plurality of antenna elements.

5. The antenna apparatus of claim 1, wherein the second subassembly further comprises one or more vias coupled to the interconnect layers and extending through the molding material to a surface of the second subassembly.

6. The antenna apparatus of claim 1, wherein at least one of the components is a transmission line coupled to the interconnect layers and extending through the molding material to a surface of the second subassembly.

7. The antenna apparatus of claim 1, wherein the first subassembly has a top surface and a bottom surface, the plurality of antenna elements are disposed at the top surface, and the first subassembly further comprising a ground plane disposed at the bottom surface.

8. The antenna apparatus of claim 1, wherein each of the antenna elements is a patch antenna element having a body fed from a point directly underneath the body by a probe feed orthogonal to a major surface of the body.

9. The antenna apparatus of claim 1, wherein the first and second subassemblies are adhered to one another by at least a plurality of ground-signal-ground (GSG) solder connections, each electrically connecting one of the antenna elements to signal and ground contacts on the interconnect layers.

10. The antenna apparatus of claim 1, wherein the components include a plurality of integrated circuit (IC) chips, and the second subassembly comprises a plurality of heat spreader tabs, each attached to a major surface of one of the IC chips.

11. The antenna apparatus of claim 10, wherein first major surfaces of each of the heat spreader tabs are attached to respective ones of the IC chips, and second, opposite major surfaces of the heat spreader tabs are exposed outside the molding material.

12. The antenna apparatus of claim 1, wherein the beamforming network and the antenna elements are configured to transmit and/or receive signals at millimeter wave frequencies.

13. The antenna apparatus of claim 1, wherein the plurality of antenna elements comprise at least sixteen antenna elements.

14. Antenna apparatus comprising:

a first subassembly comprising a plurality of antenna elements; and a second subassembly adhered to the first subassembly, the second subassembly comprising a plurality of components of a beamforming network encapsulated within a molding material, and further comprising one or more interconnect layers on the molding material to electrically couple the plurality of components of the beamforming network to the plurality of antenna elements;

wherein the plurality of components includes an input/output port, a combiner/divider network, and a plurality of integrated circuit (IC) chips each electrically coupled to at least one of the antenna elements, wherein:

the input/output port routes a transmit radio frequency (RF) signal in a transmit direction to the combiner/divider network and/or routes a combined receive RF signal from the combiner/divider network in a receive direction;

the combiner/divider network is configured to divide the RF transmit signal into a plurality of divided transmit RF signals and/or combine a plurality of modified RF receive signals, each received from one of the IC chips, into the combined RF receive signal; and each of the IC chips is configured to modify a respective one of the divided RF transmit signals to provide a modified RF transmit signal and output the same to the at least one antenna element coupled thereto and/or modify an RF receive signal provided from the at least one antenna element coupled thereto to provide one of the modified RF receive signals to the combiner/divider network.

15. The antenna apparatus of claim 14, wherein each of the IC chips comprises at least one of: (i) a transmit amplifier and/or a transmit phase shifter, or (ii) a receive amplifier and/or a receive phase shifter, to modify the divided RF transmit signal and/or the RF receive signal provided thereto.

16. The antenna apparatus of claim 14, wherein:

the input/output port is a coaxial transmission line extending from a first major surface of the second subassembly to a second, opposite major surface of the second subassembly; and the combiner/divider network is composed of coplanar waveguide supported by a dielectric disposed between the input/output port and the plurality of IC chips.

17. The antenna apparatus of claim 16, wherein the dielectric has a loss tangent lower than that of the molding material.

18. The antenna apparatus of claim 16, wherein:

the dielectric is quartz and the molding material is a liquid crystal polymer; and the first subassembly comprises a quartz substrate supporting the plurality of antenna elements.

19. Antenna apparatus comprising:

a first subassembly comprising a plurality of antenna elements; and a second subassembly adhered to the first subassembly, the second subassembly comprising a plurality of components of a beamforming network encapsulated within a molding material, and further comprising one or more interconnect layers on the molding material to electrically couple the plurality of components of the beamforming network to the plurality of antenna elements;

wherein the components comprise a plurality of integrated circuit (IC) chips arranged in rows and columns of a two dimensional array, each IC chip spaced from one another in a row direction and in a column direction and each directly underlying and electrically connected to at least two probe feeds that connect at least two corresponding antenna elements to the respective IC chip.

20. A method of forming an antenna apparatus, comprising:

forming a first subassembly comprising a plurality of antenna elements;

encapsulating a plurality of beamforming components of a beamforming network within a molding material to form an embedded component structure;

forming one or more interconnect layers on the embedded component structure, thereby forming a second subassembly; and adhering and electrically connecting the first subassembly to the second subassembly so that the plurality of beamforming components are electrically coupled to the plurality of antenna elements;

wherein said encapsulating a plurality of beamforming components comprises:

providing a carrier with adhesive foil adhered thereto;

placing the plurality of beamforming components on a surface of the adhesive foil;

applying the molding material in an uncured state around the beamforming components while placed on the adhesive foil surface;

curing the molding material to form an interim structure; and removing the carrier and the adhesive foil from the interim structure to form the embedded component structure.

21. The method of claim 20, wherein said adhering and electrically connecting the first subassembly to the second subassembly comprises heating and cooling a plurality of ground-signal-ground (GSG) solder connections between respective signal pads and ground pads on each of the first and second subassemblies.

22. The method of claim 20, wherein said forming one or more interconnect layers comprises forming a plurality of vias completely through the one or more interconnect layers for direct electrical connection of at least some of the beamforming components to respective ones of the antenna elements when the first and second subassemblies are adhered and electrically connected to one another.

23. The method of claim 20, wherein the plurality of beamforming components comprises a plurality of integrated circuit (IC) chips, a combiner/divider network formed within at least one transmission line section, and a coaxial feed-through transmission line, each placed on the surface of the adhesive foil prior to the application of the molding material.

24. The method of claim 23, further comprising forming a plurality of vias through the molding material after the curing thereof, for subsequent connection to at least one of the IC chips through the interconnect layers.

25. The method of claim 20, further comprising:

attaching heat spreader tabs to respective major surfaces of at least some of the beamforming components prior to encapsulating the beamforming components.

26. An antenna apparatus formed by:

forming a first subassembly comprising a plurality of antenna elements;

encapsulating a plurality of beamforming components of a beamforming network within a molding material to form an embedded component structure;

forming one or more interconnect layers on the embedded component structure, thereby forming a second subassembly; and adhering and electrically connecting the first subassembly to the second subassembly so that the plurality of beamforming components are electrically coupled to the plurality of antenna elements;

wherein the plurality of beamforming components includes an input/output port, a combiner/divider network, and a plurality of integrated circuit (IC) chips each electrically coupled to at least one of the antenna elements, wherein:

the input/output port routes a transmit radio frequency (RF) signal in a transmit direction to the combiner/divider network and/or routes a combined receive RF signal from the combiner/divider network in a receive direction;

the combiner/divider network is configured to divide the RF transmit signal into a plurality of divided transmit RF signals and/or combine a plurality of modified RF receive signals, each received from one of the IC chips, into the combined RF receive signal; and each of the IC chips is configured to modify a respective one of the divided RF transmit signals to provide a modified RF transmit signal and output the same to the at least one antenna element coupled thereto and/or modify an RF receive signal provided from the at least one antenna element coupled thereto to provide one of the modified RF receive signals to the combiner/divider network;

wherein each of the IC chips comprises at least one of: (i) a transmit amplifier and/or a transmit phase shifter, or (ii) a receive amplifier and/or a receive phase shifter, to modify the divided RF transmit signal and/or the RF receive signal provided thereto.

* * * * *